US009131810B2

(12) United States Patent
Reile

(10) Patent No.: US 9,131,810 B2
(45) Date of Patent: Sep. 15, 2015

(54) HAIR COLLECTION SYSTEM

(75) Inventor: Shawn Reile, San Diego, CA (US)

(73) Assignee: Shawn Reile, San Diego, CA (US)

( * ) Notice: Subject to any disclaimer, the term of this patent is extended or adjusted under 35 U.S.C. 154(b) by 794 days.

(21) Appl. No.: 13/385,513

(22) Filed: Feb. 22, 2012

(65) Prior Publication Data

US 2012/0304377 A1 Dec. 6, 2012

Related U.S. Application Data

(60) Provisional application No. 61/465,947, filed on Mar. 28, 2011.

(51) Int. Cl.
*A47K 3/022* (2006.01)
*A47K 3/28* (2006.01)

(52) U.S. Cl.
CPC ..... *A47K 3/281* (2013.01)

(58) Field of Classification Search
CPC ..... A47K 3/281; A47K 3/40; A47K 5/00; A47K 5/02; A47K 5/03
USPC ..... 4/605
See application file for complete search history.

(56) References Cited

U.S. PATENT DOCUMENTS

| | | | | |
|---|---|---|---|---|
| 4,585,199 | A * | 4/1986 | Chap | 248/682 |
| 5,060,898 | A * | 10/1991 | Chang | 248/224.51 |
| 5,178,353 | A * | 1/1993 | Huxtable | 248/222.52 |
| 5,241,714 | A * | 9/1993 | Barry | 4/605 |
| 7,407,142 | B1 * | 8/2008 | Lopez | 248/304 |
| 8,523,125 | B1 * | 9/2013 | Jardine | 248/205.3 |
| 2005/0211575 | A1 * | 9/2005 | Li | 206/77.1 |

* cited by examiner

*Primary Examiner* — Huyen Le
(74) *Attorney, Agent, or Firm* — Niall Casey

(57) ABSTRACT

A hair collection system including a backboard for providing a location for detached hair collection, a basin for capturing detached hair, and an attachment means to couple the system to a wall. The system provides a new method and apparatus for collecting detached hair before it becomes entrapped in the drain.

2 Claims, 8 Drawing Sheets

HAIR COLLECTION SYSTEM

RELATED APPLICATIONS

The present application is a non-provisional patent application claiming the benefit of priority under 35 U.S.C. 119(e) from U.S. Provisional Patent Application Ser. No. 61/465,947, filed on Mar. 28, 2011, the entire contents of which is hereby expressly incorporated by reference into this disclosure as if set forth fully herein.

FIELD OF THE INVENTION

The subject invention relates to collecting hair lost during bathing.

BACKGROUND OF THE INVENTION

This invention is a new improvement to the problem of drains becoming clogged with hair during and after bathing as well as containing the detached hair prior to disposal. The new invention catches detached hair prior to becoming entrapped in the bath or shower drain and eliminates the unsightly collection of hair on bath walls.

During a shower a bather is often times presented with a hand full of detached hair strands. Hair strands become attached to the bather and removed via hands during cleaning. In some instances the hair is transferred from the bather's hand to the bath wall. The wet hair adheres to the bath wall due to the surface tension force of the water.

The surface tension force of water causes the hair to become stuck to the bather's hand. In order to remove the wet hair from the bather's hand a stronger force must be applied to the wet hair. One means of imparting this force is to engage the wet hair to the bath wall. The force between the bath wall and the hair overcomes the force between the hand and the hair and the hair remains on the wall. Sticking hair to the wall is an effective means of removing it from the bather's hand but presents other problems. After hair has been deposited on the bath wall it can become dislodged and contribute to the clogging of drains. Additionally, the sight of hair deposited on a bath wall can be considered unsightly.

BRIEF SUMMARY OF THE INVENTION

It is therefore an object of this invention to provide a new method and apparatus for collecting detached hair before it becomes entrapped in the drain.

It is a further object of this invention to provide a location for placement of detached hair during bathing.

It is a further object of this invention to catch detached hair for disposal.

BRIEF DESCRIPTION OF THE DRAWINGS

Other objects, features, and advantages will occur to those skilled in the art from the following description of a preferred embodiment and the accompanying drawings, in which.

DETAILED DESCRIPTION

Figure 1:
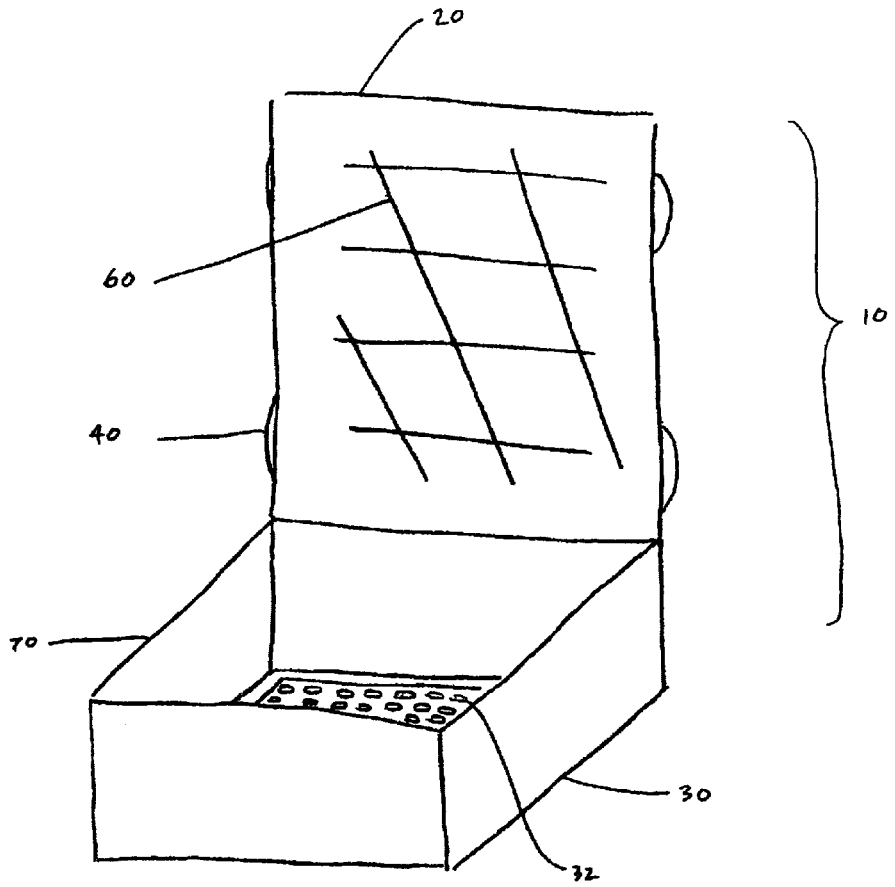
FIG. 1 is an isometric view of a hair collection system.

Aside from the preferred embodiment or embodiments disclosed below, this invention is capable of other embodiments and of being practiced or being carried out in various ways. Thus, it is to be understood that the invention is not limited in its application to the details of construction and the arrangement of components set forth in the following description or illustrated in the drawings. If only one embodiment is described herein, the claims hereof are not to be limited to that embodiment. Moreover, the claims are not to be read restrictively unless there is clear and convincing evidence manifesting a certain exclusion, restriction or disclaimer.

FIG. 1 is an isometric view of a hair collection system. Hair collection system 10 functions to collect hair during a shower for easy disposal. Backboard 20 provides a location for hair placement. Backboard 20 has surface 60 to encourage hair to temporarily adhere to backboard 20. Surface 60 can be angled with respect to a vertical plane, such as a wall. Basin 30 provides a location for collection of hair that has been washed from backboard 20. Holes 32 in bottom of basin provide for water to flow through but hair to remain within basin 30. Basin 30 has vertical walls 70 to provide for collection of hair within basin 30. Fixation members 40 provide attachment of system to bath walls. Fixation members 40 can provide for variable distance between mounting surface and backboard 20.

Figure 2:
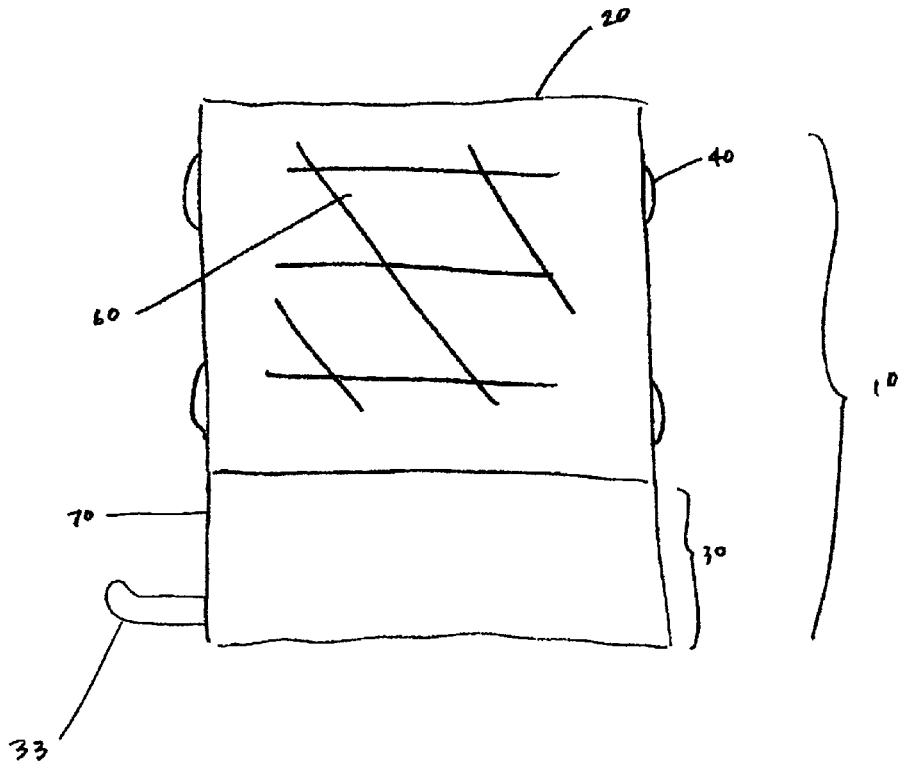
FIG. 2 is front view of a hair collection system.

FIG. 2 is front view of a hair collection system. Arms 33 can be configured to provide a place to hang shower accessories. In on embodiment, arms 33 can be substantially horizontal to allow for hanging of tethered objects. Singular or multiple arms 33 can be positioned to provide a yoke to hang a T-shaped object, such as a razor. Arms 33 can be located on any exposed surface of basin 30 or backboard 20.

Figure 3:
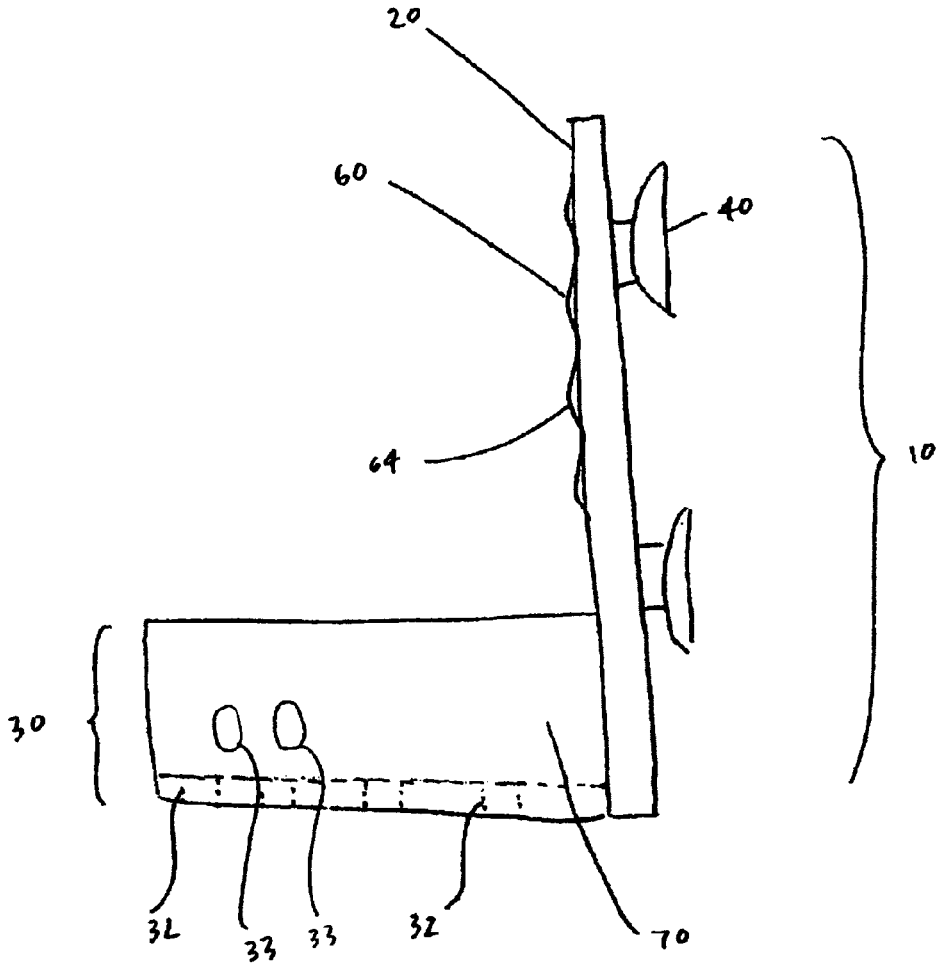
FIG. 3 is a side view of a hair collection system.

FIG. 3 is a side view of a hair collection system. Surface 60 can be configured to be undulating into and out of the vertical plane in vertical and/or horizontal directions. Surface 60 can further be configured to provide increased adhesion properties based on surface treatments. Surface 60 can be angled with respect to a vertical plane. Geometrical features can be configured in any pattern to promote adhesion to backboard 20. Hydrophilic or hydrophobic surface treatments may be used to promote transfer of hair from hand to backboard 20.

Figure 4:
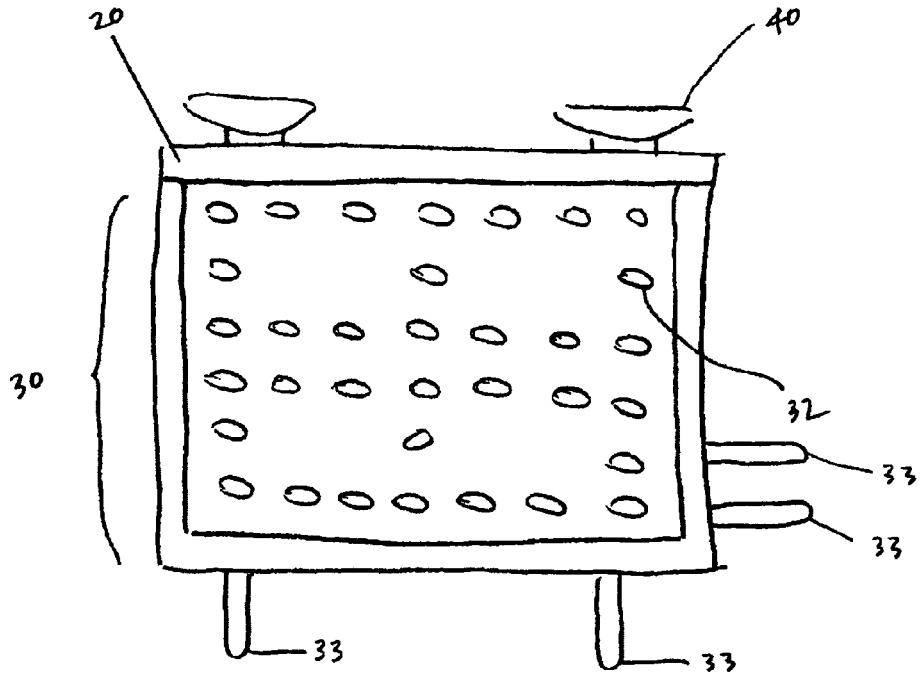
FIG. 4 is a top view of a hair collection system.

FIG. 4 is a top view of a hair collection system. Holes 32 can be arranged in any pattern to facilitate water flow and hair collection.

Figure 5:
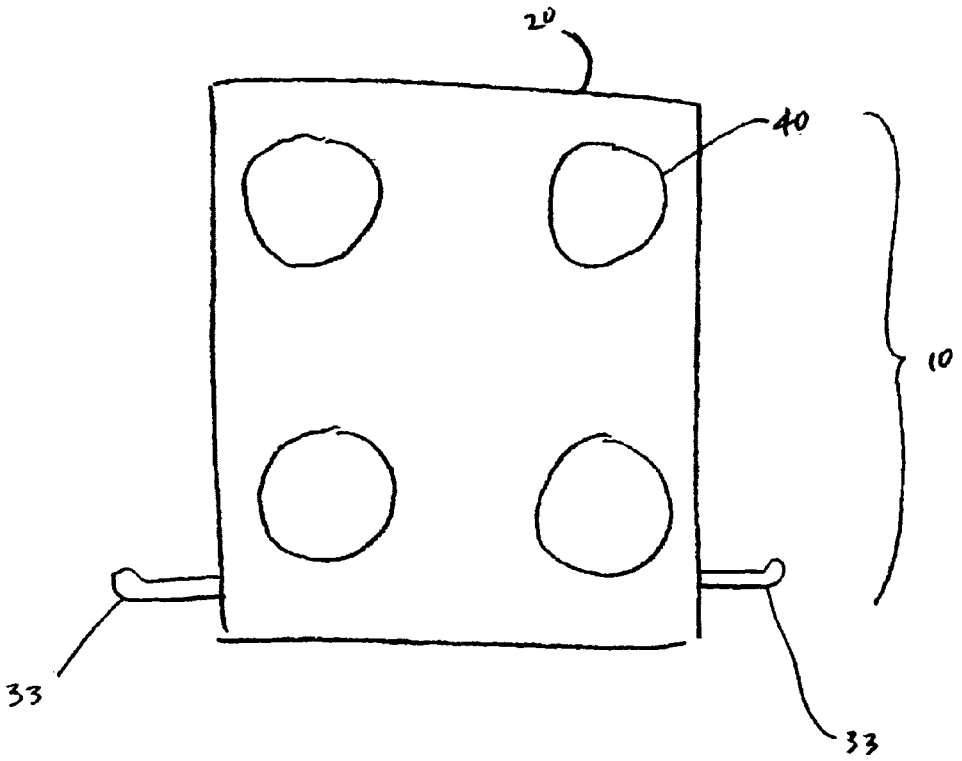
FIG. 5 is a back view of a hair collection system.

FIG. 5 is a back view of a hair collection system. Fixation members 40 can be arranged in any pattern to facilitate temporary or permanent fixation between system 10 and bath wall. Temporary fixation members 40 can be configured as suction cups, adhesive pads, hooks, hangers, magnets, or hook and eye connections. Permanent fixation members can be configured as adhesive pads, resin, liquid, or bonding agent.

Figure 6:
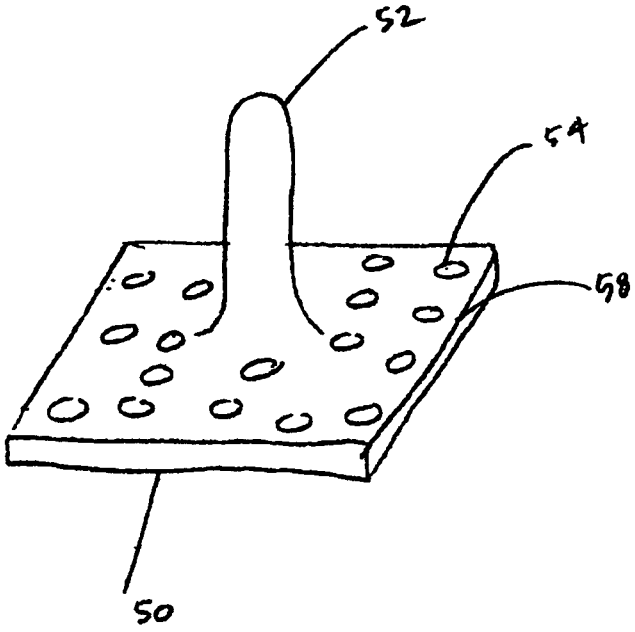
FIG. 6 is a view of an insert of a hair collection system.

FIG. 6 is a view of an insert of a hair collection system. Insert 50 can be temporarily installed within basin 30 to provide a means of disposing of collected hair within basin 30. Cleaning and removing hair from system 10 can be performed by removing insert 50 and disposing hair caught by insert 50. Insert 50 can contain holes 54 through base 58 to provide for water to flow through insert 50. Removal feature 52 provides for removal of insert 50 from basin 30 for collected hair disposal and cleaning. In the pictured embodiment the removal feature is a post but future embodiments can include a boss, eyelet, or other means for removing insert 50 from basin 30.

Figure 7:
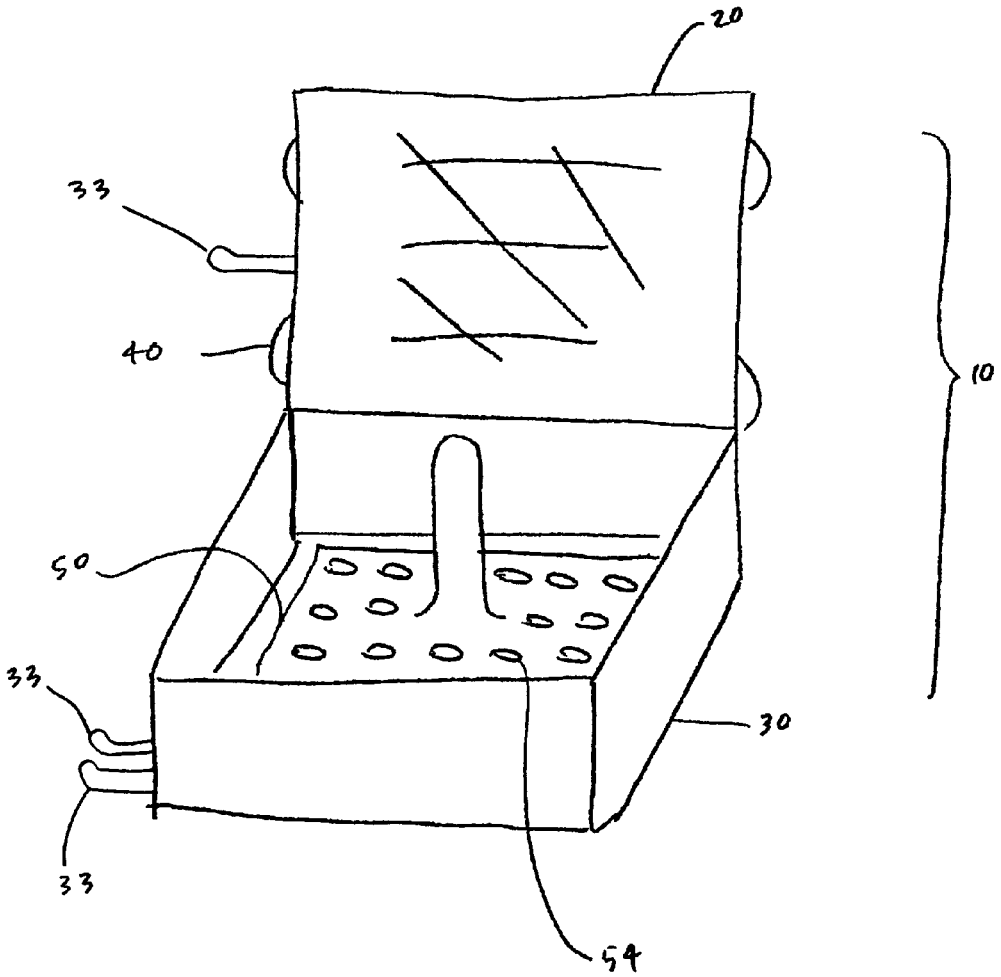
FIG. 7 is a view of a hair collection system.

FIG. 7 is a view of a hair collection system. Insert 50 has been placed within basin 30 to provide a means of removing collected hair for disposal. Holes 54 in insert 50 can be configured to coincide, partially coincide, or occlude holes 32 within basin 30 to provide for proper hair collection and water flow.

Figure 8:
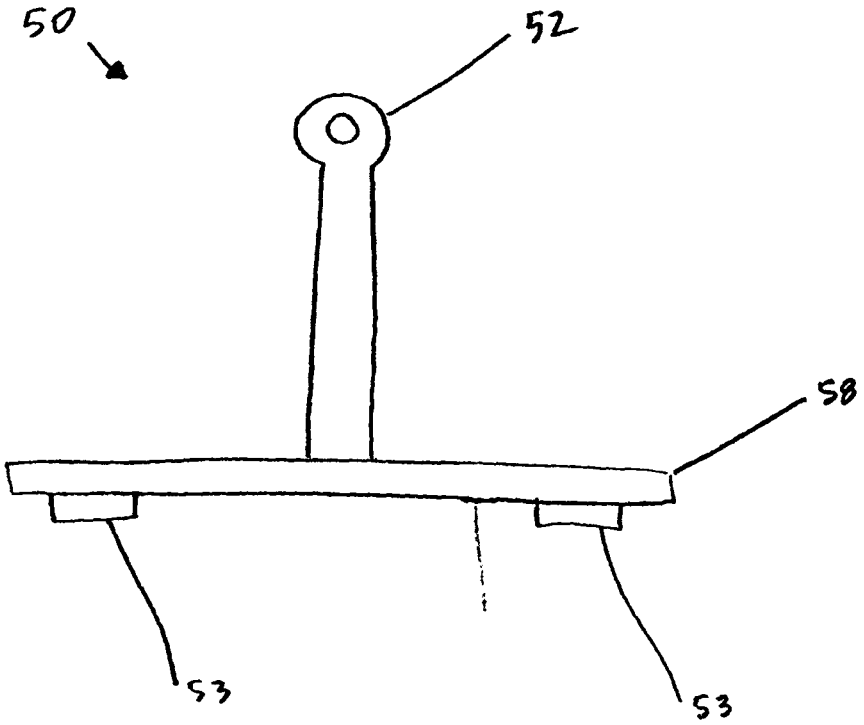
FIG. 8 is a side view of an insert of a hair collection system.

FIG. 8 is a side view of an insert of a hair collection system. Insert 50 can be configured to have prominences 53 to create space between the bottom surface of insert base 58 and the surface of the floor of basin 30. Hair removal system 10 can be configured without insert 50.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended. Other embodiments will occur to those skilled in the art and are within the following claims.

What is claimed is:

1. A hair collection system comprising:

a backboard with an undulating surface for providing a location for detached hair collection;

a basin for capturing detached hair;

an insert removably contained within the basin; and an attachment means to removably couple the system to a wall.

2. A hair collection system comprising:

a backboard with geometric bosses for providing a location for detached hair collection;

a basin for capturing detached hair;

an insert removably contained within the basin; and an attachment means to removably couple the system to a wall.

* * * * *